US006834177B2

(12) United States Patent
Saito et al.

(10) Patent No.: US 6,834,177 B2
(45) Date of Patent: Dec. 21, 2004

(54) IMAGE FORMING APPARATUS HAVING TRANSFER ROLLER FORMING A NIP WITH IMAGE BEARING BELT AND REGULATING MEMBER FOR SAME

(75) Inventors: Hisahiro Saito, Shizuoka-ken (JP); Yasuo Yoda, Numazu (JP); Kenichi Iida, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 1 day.

(21) Appl. No.: 10/229,073

(22) Filed: Aug. 28, 2002

(65) Prior Publication Data

US 2003/0113141 A1 Jun. 19, 2003

(30) Foreign Application Priority Data

Aug. 28, 2001 (JP) ..... 2001-258418
Aug. 19, 2002 (JP) ..... 2002-238317

(51) Int. Cl.[7] ..... G03G 15/16; G03G 15/01
(52) U.S. Cl. ..... 399/313; 399/302
(58) Field of Search ..... 399/162, 297, 399/302, 308, 310, 313, 316, 318

(56) References Cited

U.S. PATENT DOCUMENTS

| | | | | |
|---|---|---|---|---|
| 4,544,262 A | * | 10/1985 | Kanemitsu et al. | 399/316 |
| 5,046,947 A | | 9/1991 | Endoh et al. | 432/60 |
| 5,116,711 A | | 5/1992 | Kobayashi et al. | 430/106 |
| 5,149,610 A | | 9/1992 | Kobayashi et al. | 430/106 |
| 5,154,411 A | | 10/1992 | Saito et al. | 271/289 |
| 5,164,275 A | | 11/1992 | Kobayashi et al. | 430/45 |
| 5,191,382 A | | 3/1993 | Okamura et al. | |
| 5,256,512 A | | 10/1993 | Kobayashi et al. | 430/106 |
| 5,298,954 A | * | 3/1994 | Fujita et al. | 399/313 |
| 5,298,959 A | | 3/1994 | Saito et al. | |
| 5,565,975 A | * | 10/1996 | Kumon et al. | 399/302 |
| 5,580,042 A | | 12/1996 | Taniguro et al. | 271/274 |
| 5,620,174 A | | 4/1997 | Taniguro et al. | 271/10.12 |
| 5,672,019 A | | 9/1997 | Hiramatsu et al. | 400/624 |
| 5,725,319 A | | 3/1998 | Saito et al. | 400/629 |
| 5,732,310 A | | 3/1998 | Hiroshima et al. | 399/101 |
| 5,809,373 A | | 9/1998 | Yoda et al. | 399/101 |
| 5,893,022 A | * | 4/1999 | Yoshino et al. | 399/302 X |
| 5,918,873 A | | 7/1999 | Saito et al. | 271/10.11 |
| 6,168,270 B1 | | 1/2001 | Saikawa et al. | 347/104 |
| 6,298,212 B1 | * | 10/2001 | Kono et al. | 399/302 |
| 6,305,682 B1 | | 10/2001 | Saito et al. | 271/10.11 |
| 6,353,721 B1 | * | 3/2002 | Yamaguchi et al. | 399/302 X |
| 6,405,006 B1 | * | 6/2002 | Tabuchi | 399/162 |
| 6,449,453 B1 | * | 9/2002 | Motobashi | 399/302 |

FOREIGN PATENT DOCUMENTS

JP 63-301960 12/1998

* cited by examiner

*Primary Examiner*—Sandra L. Brase
(74) *Attorney, Agent, or Firm*—Fitzpatrick, Cella, Harper & Scinto

(57) ABSTRACT

An image forming apparatus includes an image bearing belt; a supporting roller for supporting the image bearing belt; a transfer roller for forming a nip with the image bearing belt, wherein an image is transferred from the image bearing belt onto a transfer material at the nip by applying a voltage to set transfer roller; wherein the nip has a first nip portion where the transfer roller is contacted to the image bearing belt without being backed up by the supporting roller, and a second nip portion where the transfer roller is contacted to set image bearing belt by being backed up by the supporting roller, the first nip portion being upstream of the second nip portion; and a regulating member for regulating a discharging the direction of the transfer material to be discharged from the nip.

11 Claims, 5 Drawing Sheets

IMAGE FORMING APPARATUS HAVING TRANSFER ROLLER FORMING A NIP WITH IMAGE BEARING BELT AND REGULATING MEMBER FOR SAME

FIELD OF THE INVENTION AND RELATED ART

The present invention relates to an electrophotographic image forming apparatus such as a copying machine, a printer, and the like.

An image forming apparatus which employs an intermediary transfer belt has long been known. An image forming method employing an intermediary transfer belt is effective for full-color image forming apparatuses or multicolor image forming apparatuses for synthetically obtaining full-color images or multicolor images through an image formation process, in which a plurality of temporary images different in color formed sequentially in accordance with full-color image formation data or multicolor image formation data are sequentially transferred in layers onto an intermediary transfer medium to synthesize full-color images or multicolor images, respectively.

FIG. 5 shows the general structure of a typical image forming apparatus employing an intermediary transfer belt in accordance with conventional arts. This image forming apparatus is a color image forming apparatus (copying machine, laser beam printer, or the like) having an intermediary transfer belt 120. The material for this intermediary transfer belt 120 is an elastic substance, the electrical resistance of which is in the mid range.

This image forming apparatus comprises an electrophotographic photoconductive member 101 (which hereinafter will be referred to as photoconductive drum) in the form of a drum. This photoconductive drum 101 is rotationally driven in the direction indicated by an arrow mark at a predetermined peripheral velocity (process speed).

As the photoconductive drum 101 is rotationally driven, it is uniformly charged by a primary charging device 102 to predetermined polarity and potential level, and is exposed to a beam of light 103 projected by an exposing means while being modulated with image formation data. As a result, an electrostatic latent image corresponding to one of the color components (for example, yellow color component) of an intended color image is formed on the photoconductive drum 101.

Next, the electrostatic latent image is developed into a visual image, that is, a yellow toner image, by first developing device 141 (yellow color component developing device), in the developing station. During this process of developing the electrostatic latent image corresponding to the yellow color component, second to fourth developing devices 2–4, that is, a magenta color component developing device 142, a cyan color component developing device 143, and a black color component developing device 144, are kept inactive; they do not act on the photoconductive drum 101. Therefore, the yellow toner image is not affected by the second to fourth developing devices 142–144. The first to fourth developing devices 141–144 are mounted in a supporting member 140 rotatable about its center axle, being enabled to be sequentially moved to the development station, in which they oppose the photoconductive drum 101 as they are moved into the development station.

The intermediary transfer belt 120 is stretched around rollers 161 and 162, and a primary transfer roller 125, being positioned so that it is placed in contact with the peripheral surface of the photoconductive drum 101 at a predetermined contact location. It is rotationally driven at the same peripheral velocity as that of the photoconductive drum 101 in such a direction that its peripheral surface moves in the same direction as that of the photoconductive drum 101, at the contact location. At the contact location, a primary transfer roller 125 is disposed on the inward side of the loop of the intermediary transfer belt 120, so that a primary transfer bias can be applied to the intermediary transfer belt 120 from a bias power source 129 through the primary transfer roller 125. The primary transfer bias is opposite in polarity to the toner, and its potential level is within the range of +100 V–2 kV.

While the yellow toner image on the photoconductive drum 101 is passed through the contact area, or recording paper nipping portion (which hereinafter will be simply referred to as nip), between the photoconductive drum 101 and intermediary transfer belt 120, it is continually transferred onto the outwardly facing surface of the intermediary transfer belt 120, with reference to the belt loop, by the primary transfer electric field formed by the primary transfer bias applied to the intermediary transfer belt 120 through the primary transfer roller 125.

After the transfer of the yellow toner image, that is, the toner image corresponding to the first color component, onto the intermediary transfer belt 120, the primary transfer residual toner particles, that is, the toner particles remaining on the peripheral surface of the photoconductive drum 101 after the primary transfer of the yellow toner image, are removed by a cleaning apparatus 113; the peripheral surface of the photoconductive drum 101 is cleaned by the cleaning apparatus 113. Thereafter, the cleaned portion of the peripheral surface of the photoconductive drum 101 is again subjected to the above described image forming process which begins with the primary charging of the photoconductive drum 101, to form a magenta toner image, or the toner image corresponding to the second color component, on the photoconductive drum 101, and transfer the magenta toner image onto the intermediary transfer belt 120 in such a manner that the magenta image is placed in layers on the yellow toner image. This process is repeated two more times, to sequentially form a cyan toner image, or the toner image corresponding to the third color component, and a black toner image, or the toner image corresponding to the fourth color component, on the photoconductive drum 101, and sequentially transfer them in layers onto the preceding two toner images on the intermediary transfer belt 120. As a result, a synthetic full-color image reflecting the intended color image is effected on the intermediary transfer belt 120.

The roller 164, which supports the intermediary transfer belt 120, doubles as a roller which opposes a secondary transfer roller 163 located outside the loop of the intermediary transfer belt 120. The secondary transfer roller 163 is enabled to be moved so that it can be pressed against the roller 164 with the interposition of the intermediary transfer belt 120, or can be moved away from the intermediary transfer belt 120 and roller 164. To the secondary transfer roller 163, a secondary transfer bias is applied from a bias power source 128. Further, the secondary transfer roller 163 is enabled to be kept away from the intermediary transfer belt 120 during the primary transfer of the toner images corresponding to the first-fourth color components of the intended image.

Immediately before the four color toner images transferred in layers on the intermediary transfer belt 120 reach the secondary transfer station due to the rotation of the intermediary transfer belt 120, the application of the secondary transfer bias to the secondary transfer roller 163 from the bias power source 128 is started, and at the same time, the secondary transfer roller 163 is placed in contact with the intermediary transfer belt 120. Meanwhile a transfer medium P as recording medium (paper, resinous sheet, and the like) is sent into the recording medium path by a sheet feeding roller pair 111 with a predetermined timing, and is delivered, being guided by a guide 110, to the contact area between the secondary transfer roller 163 and intermediary transfer belt 120.

While the transfer medium P is passed through the contact area, or the recording paper nipping portion, between the transfer roller 163 and intermediary transfer belt 120, the four color toner images, different in color, on the intermediary transfer belt 120 are continually transferred together onto the transfer medium P by the secondary transfer electric field formed by the secondary transfer bias applied to the intermediary transfer belt 120 from the secondary transfer roller 163. After the transfer of the four color toner images onto the transfer medium P, the transfer medium P is introduced into a fixing device 115, in which the four color toners are fixed (melted, mixed, and permanently adhered to the transfer medium P), by the heat and pressure applied by the fixing apparatus 115, effecting a permanent full-color print.

The secondary transfer residual toner particles, that is, the toner particles remaining on the peripheral surface of the intermediary transfer belt 120 after the secondary transfer, are charged by a belt cleaner 108 to the polarity opposite to that of the photoconductive drum 101. The belt cleaner 108 is a roller located outside the loop of the intermediary transfer belt 120, being enabled to be placed in contact with, or moved away from, the intermediary transfer belt 120. More specifically, the secondary transfer residual toner particles are charged to the predetermined polarity as a cleaning bias with the predetermined polarity is applied to the belt cleaner, that is, the roller 108, from a bias power source 126 through a grounded electrically conductive roller 107 as the opposing electrode, disposed within the loop of the intermediary transfer belt 120, while the roller 108 is kept in contact with the outward surface of the intermediary transfer belt 120. In this embodiment, the photoconductive drum 101 is negatively charged. Thus, the secondary transfer residual toner particles are charged to the positive polarity. The belt cleaner 108 is enabled to be kept away from the intermediary transfer belt 120 during the primary transfer of the first to third toner images corresponding to the first to third color components, one for one.

After being charged to the polarity opposite to that of the photoconductive drum 101, the secondary transfer residual toner particles on the intermediary transfer belt 120 are electrostatically attracted onto the photoconductive drum 101, in the contact area between the intermediary transfer belt 120 and photoconductive drum 101, as well as the adjacencies of the contact area; they are removed from the intermediary transfer belt 120.

In the case of a color image forming apparatus, such as the one disclosed in Japanese Laid-open Patent Application 63-301960, which employs a transfer drum, a color image is obtained by transferring a plurality of toner images different in color onto a transfer medium held on the peripheral surface of a transfer drum, directly from the photoconductive drum. Thus, this type of color image forming apparatus requires a recording medium controlling means for holding a recording medium to the transfer drum (for example, recording medium may be held to transfer drum by gripper, glue, suction, or may be given a curvature matching that of peripheral surface of transfer drum). In comparison, the color image forming apparatus in this embodiment employs the above described intermediary transfer belt, eliminating the need for the above described recording medium controlling means. Further, the provision of the intermediary transfer belt enables the color image forming apparatus in this embodiment to form satisfactory color images regardless of the thickness, width, and length of a recording medium; in other words, it enables the apparatus to form satisfactory color images on an envelope, a post card, a label, or the like, in addition to ordinary recording paper, although the thickness of a recording medium should be within the range of 40 $g/m^2$ (thin paper)–200 $g/cm^2$ (cardboard).

Because of the above described advantage, a color image forming apparatus employing an intermediary transfer belt is widely used in the form of a color copying machine, a color printer, and the like.

Currently, the desire for faster speed, higher quality, and longer service life is very strong even in the field of image forming apparatus employing an intermediary transfer belt. In the field of color image forming apparatus, efforts have been made, in particular, for higher image quality. For example, in recent years, the number of users who use glossy paper to obtain high quality images which give the impression of an image created by silver salt photography has been increasing. Also, some users began to form an image on both sides of glossy paper to make a book. However, because glossy paper is generally high in electrical resistance, the usage of glossy paper in the low humidity environment has been creating the problem of the electrical discharge occurring in the secondary transfer station, resulting in a defective image. This problem was more prevalent in the case of double-sided printing. As a method for preventing the image defects traceable to the electrical discharge which occurs as a printing paper enters the secondary transfer station, the method disclosed in Japanese Laid-open Patent Application 9-90780 is well known.

This method is effective to prevent electrical discharge from occurring on the entrance side of the secondary transfer station. However, it does not mention the electrical discharge which occurs at the exit side of the secondary transfer station.

In spite of the superiority of an intermediary transfer belt in terms of the conformity to recording paper, even an image forming apparatus employing an intermediary transfer belt suffers from its own problems. One of the two significant problems of such an image forming apparatus is the image defects (image defects of a first type) traceable to the electrical discharge which occurs when a transfer medium enters the secondary transfer station, and the other is the image defects (image defects of a second type, which look like bird s foot prints) traceable to the electrical discharge which occurs when the recording medium exits from the secondary transfer station. In spite of this fact, the measure for preventing the image defect of the second type is not proposed in the method disclosed in Japanese Laid-open Patent Application.

SUMMARY OF THE INVENTION

The primary object of the present invention is to prevent the image defects which occur in the second transfer station, that is, the contact areas between the intermediary transfer belt and photoconductive member, so that it becomes possible to provide an image forming apparatus capable of forming high quality images on a wide variety of recording medium.

According to the primary aspect of the present invention, an image forming apparatus comprises: an image bearing belt for bearing an image; a supporting roller for supporting said image bearing belt; a transfer roller which forms a transfer medium nipping portion against said image bearing member; and a regulating member for regulating the direction in which a transfer medium is discharged from said transfer medium nipping portion, wherein a single or plurality of images on said image bearing belt are transferred by the application of voltage to said transfer roller onto a transferring medium being moved; said transfer medium nipping portion has a first area which is not backed up by said supporting roller, and across which said image bearing member and transfer roller make contact with each other, and a second area which is backed up by said supporting roller, and across which said image bearing belt and transfer roller make contact with each other, and wherein the first area of said transfer medium nipping portion is on the upstream side of the second area of said transfer medium nipping portion in terms of the moving direction of the transfer medium.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Hereinafter, the preferred embodiments of the present invention will be described with reference to the appended drawings.

Figure 1:
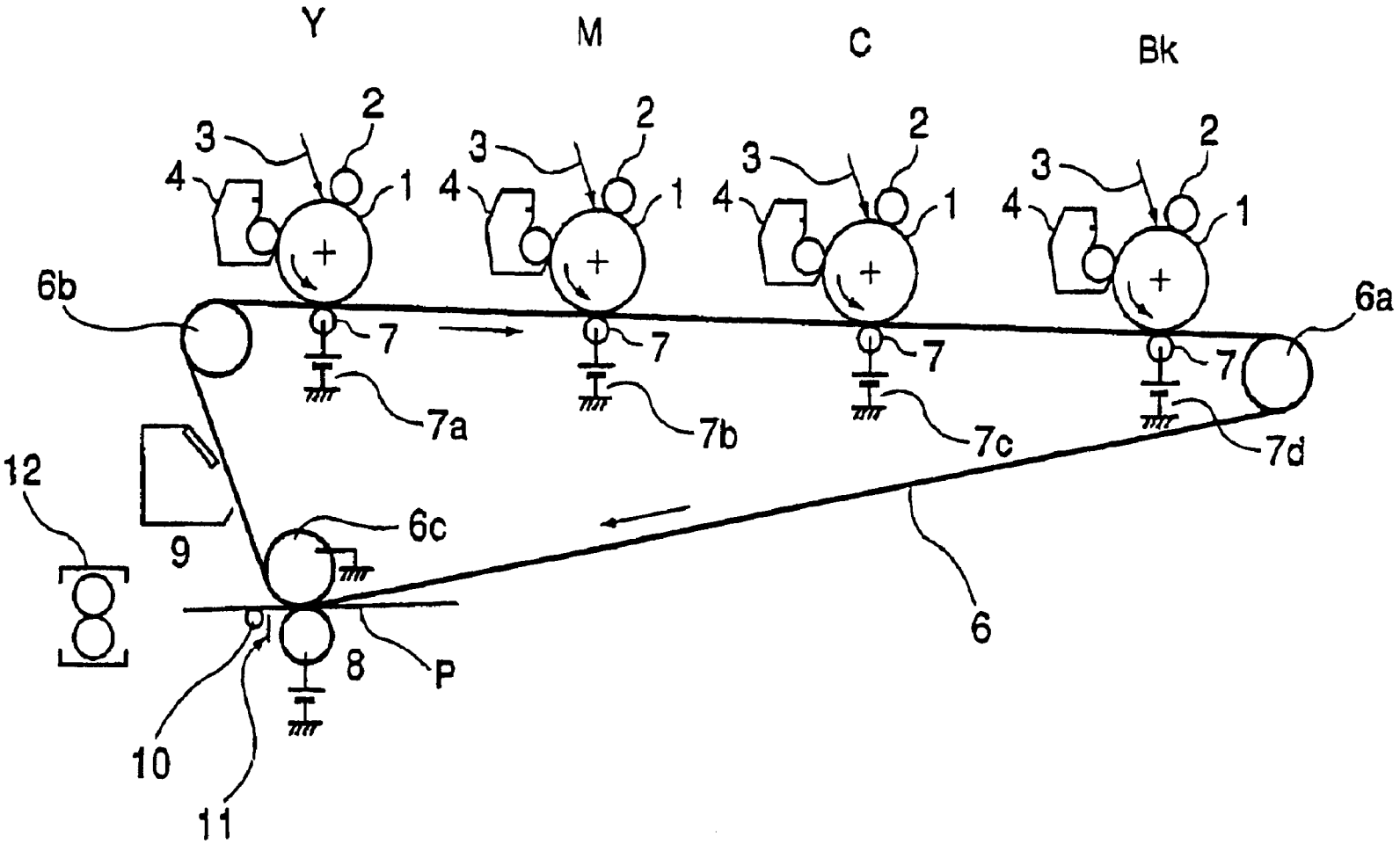
FIG. 1 is a schematic drawing for showing an image forming apparatus in an embodiment of the present invention.

FIG. 1 is a schematic drawing for showing the general structure of an image forming apparatus in accordance with the present invention.

The color laser printer shown in FIG. 1 is an in-line type printer, that is, a printer which comprises: a plurality of photoconductive drums 1 as first image bearing members serially positioned (in-line type) in the recording medium conveyance direction; and an intermediary transfer belt 6 as a second image bearing member. In operation, a plurality of toner images different in color are sequentially formed on the peripheral surfaces of the plurality of photoconductive drums 1, one for one, and then, are sequentially transferred in layers onto the intermediary belt 6, to form a full-color image.

The intermediary transfer belt 6 is an endless belt. It is suspended around a driving roller 6*a*, a tension roller 6*b*, and a belt backing roller 6*c*, which opposes the secondary transfer roller 8 in the secondary transfer station. It is rotationally driven in the direction indicated by an arrow mark in the drawing at a process speed of 117 mm/sec. The driving rollers 6*a*, tension roller 6*b*, and belt backing roller 6*c* constitute the supporting rollers for supporting the intermediary transfer belt 6. The intermediary transfer belt 6 is formed of polyimde adjusted in electric resistance by carbon black, being therefore enabled to conduct electrons. It is $1\times10^8$ Ω·cm in volumetric resistivity, 75 μm in thickness, 1116 mm in internal circumference, and 350 mm in width, that is, the dimension in terms of the direction perpendicular to its moving direction. Since its electrical resistance value is $1\times10^8$ Ω·cm, electrical charge does not remain in the intermediary transfer belt 6 after the toner image transfer, eliminating the need for a charge removing mechanism, which in turn reduces apparatus cost. Incidentally, the image forming apparatus in this embodiment is provided with the primary transfer electrode with a relatively low electrical resistance, and the combination of this primary transfer electrode and the above described intermediary transfer belt 6 makes it possible to transfer toner images with the application of relative low voltage, in the primary transfer station, preventing the image defects traceable to the electrical discharge in the primary transfer station. This subject will be further described later. The electrical resistance range, in which electrical charge does not remain in the intermediary transfer belt 6 after the toner image transfer, is called a self attenuation range of the intermediary transfer belt 6, and is $1\times10^7$ Ω·cm–$1\times10^{12}$ Ω·cm.

The aforementioned resistance value was obtained by measuring the electrical resistance of the intermediary transfer belt 6, following JIS-K6911. More concretely, the volumetric resistivity of the intermediary transfer belt 6 was measured using an Ultrahigh Resistance Meter R8340 (commercial name: Advantest Co., Ltd.) under the condition in which an electrode formed of electrically conductive rubber was used to keep the surfaces of the electrode and intermediary transfer belt 6 satisfactorily in contact with each other; and a voltage of 100 V was applied for a duration of 30 seconds.

The image forming apparatus is also provided with a density control sensor (unshown), which is disposed in the adjacencies of the intermediary transfer belt 6 to optically detect a patch (image for density detection) for adjusting the image density. The aforementioned four photoconductive drums 1, which correspond one for one to the four color components, are serially arranged in the moving direction of the intermediary transfer belt 6.

The photoconductive drum 1 coupled with the yellow color component developing device, for example, is uniformly charged to predetermined polarity and potential level by the primary charge roller 2, as the photoconductive drum 1 is rotated. Then, it is exposed to a beam of laser light 3 projected from an unshown laser scanner, that is, an exposing means (comprising: system for separating colors of color original; system for focusing beam of laser light; and image formation information processing system; and like), while being modulated with the sequential digital electrical picture element signals reflecting the image formation data. As a result, an electrostatic latent image corresponding to the first color component (yellow color component) of an intended color image is formed on the photoconductive drum 1. The exposure resolution of the image forming apparatus in this embodiment is 600 dpi.

Next, the electrostatic latent image is developed by the first developing device 4 (yellow color component developing device) and yellow toner, or the toner of the first color component, into a yellow toner image. The yellow toner image formed on the photoconductive drum 1 enters the primary transferring station, that is, the transfer medium nipping portion between the intermediary transfer belt 6 and photoconductive drum 1. In the transfer medium nipping portion, a voltage applying member 7 (primary transfer roller) is placed in contact with the inward side of the intermediary transfer belt 6, in terms of the intermediary transfer belt loop. In order to make it possible to apply bias independently to each of the plurality of the voltage applying members 7, in the corresponding transfer stations, the image forming apparatus in this embodiment is provided with primary transfer bias power sources 7*a*–7*d*. In the first transfer station, the toner image of yellow color is transferred onto the intermediary transfer belt 6. Then, in the second to fourth transfer stations, the toner images of the magenta, cyan, and black colors, respectively, which are formed through the above described toner image formation processes, are sequentially transferred in layers onto the intermediary transfer belt 6, effecting a full-color image. Then, the full-color image is transferred together onto a transfer medium P by the secondary transfer roller 8. Then, the full-color image on the transfer medium P is welded (fixed) to the transfer medium P by the fixing apparatus 12, effecting a color print. The secondary transfer residual toner particles, that is, the toner particles remaining on the intermediary transfer belt 6 after the secondary image transfer are removed by a cleaning apparatus 9, which comprises an elastic blade. The cleaning apparatus is disposed on the upstream side of the tension roller 6*b* in terms of the rotational direction of the intermediary transfer belt 6.

Next, the transfer stations will be described in details. In each primary transfer station, the toner image on the photoconductive drum 1 is transferred onto the intermediary transfer belt 6 by the application of a voltage of approximately 400 V. As the voltage applying member 7, an electrically conducive roller, the external layer of which is formed of foamed substance is employed. It is 16 mm in diameter and $1\times10^6$ Ω·cm in electrical resistance. In the secondary transfer station, a single or plurality of toner images on the intermediary transfer belt 6 are transferred onto a recording paper, as a transfer medium, by the application of a bias of 1,500–6,000 V to the secondary transfer roller 8. After the transfer of the toner images onto the recording paper, the recording paper is cleared of electrical charge by a charge removing needle 11, which is placed in contact with the back side of the recording paper, and to which a DC voltage is being applied. Then, the recording paper is conveyed by a plurality of conveying rollers 10 aligned in the direction perpendicular to the recording paper conveyance direction, to the unshown fixing apparatus, in which the toner images are fixed. In other words, the conveying rollers 10 constitute the regulating members for regulating the angle at which the transfer medium is discharged from the transfer medium nipping portion after being passed through the nipping portion. As for the secondary transfer roller 8, an electrically conductive foamed roller, which is 38 degrees in hardness (Asker scale C) and $3\times10^8$ Ω·cm in electrical resistance, is used. As for the roller 6*c* positioned in a manner to oppose the secondary transfer roller 8, an electrically conductive rubber roller, which is 30 degrees in hardness (JIS A) and $1\times10^6$ Ω·cm is employed.

Here, first, the image defect of a first type, which occurs on the entrance side of the transfer station, will be described. If a recording paper enters the transfer medium nipping portion with the presence of air gaps between the recording paper and image bearing member, electrical discharge occurs between the recording paper and image bearing member, which results in the image defect of the first type. In the past in which a monochromatic image forming apparatus was the prevailing image forming apparatus, this problematic phenomenon was dealt with by the guides which guided a recording paper into the transfer station; in other words, it was a common practice to guide a recording paper into the transfer medium nipping portion so that the recording paper conforms to the image bearing member side. It is reasonable to think that this solution is effectively applicable to the image defect traceable to the second transfer station, as it is inevitably present in an image forming apparatus employing an intermediary transfer belt.

However, recent color image forming apparatuses employing an intermediary transfer belt are required to handle a wider range of recording papers in terms of basis weight. Thus, if the guiding plates of a recent color image forming apparatus, which employs an intermediary transfer belt and is capable of handling various recording papers, the basis weight of which ranges from 60 g/m$^2$ (thin paper) to 220 g/m$^2$ (cardboard), are positioned to guide the recording papers into the secondary transfer medium nipping portion in a manner to make the recording papers conform to the intermediary transfer belt, in order to prevent the image defect of the first type, they create a problem in that cardboard causes a shock when it is fed into the transfer medium nipping portion.

Figure 2:
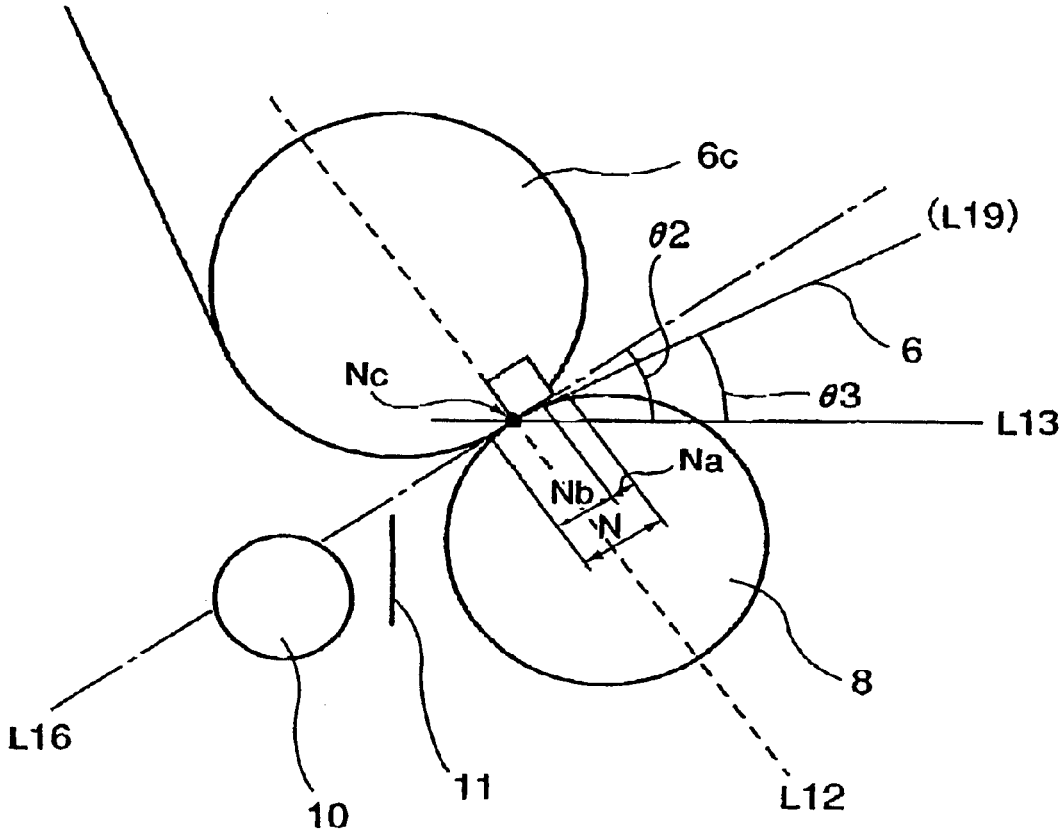
FIG. 2 is a schematic drawing for showing the direction from which the intermediary transfer belt is made to enter the nipping portion.

Referring to FIG. 2, in this embodiment, therefore, the belt backing roller 6*c*, secondary transfer roller 8, and conveying rollers 10 are positioned in a manner to divide the transfer medium nipping portion N into two distinctive portions; a portion Na in which the intermediary transfer belt 6 contacts the secondary transfer roller 8 without being backed up by the belt backing roller 6*c*, and a portion Nb in which the intermediary transfer belt 6 contacts the secondary transfer roller 8 while being backed up by the belt backing roller 6*c* (in other words, portion Nb is formed by belt backing roller 6*c* and transfer roller 8 with the interposition of intermediary transfer belt 6). In terms of the transfer medium conveyance direction, the nipping portion Na, which hereinafter may be referred to as the first nipping portion, is on the upstream side of the nipping portion Nb, which hereinafter may be referred to as the second nipping portion.

In other words, the image defect of the first type can be prevented by positioning the aforementioned belt backing roller 6*c*, secondary transfer roller 8, and conveying rollers 10, as shown in FIG. 2, that is, in such a manner that the angle θ2 formed by a straight line L16 and the horizontal line L13, and the angle θ3 formed by the direction L19 and the horizontal line L13, satisfy the following inequality: $\theta2-\theta3>0$. The straight line L16 is such a line that perpendicularly intersects with the straight line L12 connecting the centers of the belt backing roller 6*c* and secondary transfer roller 8, at the center Nc of the transfer medium nipping portion N, and the direction L19 is the direction in which the intermediary transfer belt 6 is made to enter the transfer medium nipping portion. Given below in Table 1 are the results of the experiments carried out to examine the relationship between the values of (θ2−θ3) and the image defect of the first type. The external diameters of the secondary transfer roller 8 and belt backing roller 6*c* used in the experiments were 16 mm and 23 mm, respectively.

TABLE 1

| θ2−θ3 (deg.) | −1 | 0 | 1 | 5 | 8 |
|---|---|---|---|---|---|
| First image defect | N | F | G | G | G |

G: No defect,
F: Slight,
N: Defective

When the value of (θ2−θ3) was no more than 0°, in other words, when the intermediary transfer belt 6 did not contact the secondary transfer roller 8 without being backed up by the belt backing roller 6*c* on the upstream side of the transfer medium nipping portion N in terms of the intermediary transfer belt conveyance direction, the image defect of the first type sometimes occurred under the condition in which the temperature and humidity were 10° C. and 15% RH, respectively; more specifically, the image formed on the second side of a recording medium sometimes suffered from the image defects of the first type when in the two-sided printing mode.

In other words, as long as the inequality (θ2−θ3>0) was satisfied, the image defect of the first type did not occur.

Incidentally, when the value of (θ2−θ3) was excessively large, quality of a halftone image or the like sometimes reduced in terms of uniformity. More specifically, it was discovered that when the value of (θ2−θ3) was no less than 10°, a halftone image or the like sometimes suffered from unwanted spots traceable to rubbing. This phenomenon is likely to occur when cardboard with a basis weight of 220 $g/m^2$ is used as a recording paper.

In other words, in order to prevent the image defect traceable to rubbing as well as the image defect of the first type, (θ2−θ3) must satisfy the following inequality: θ2−θ3<10°. Thus, the preferable range for (θ2−θ3), that is, the range in which neither the image defect of the first type nor the image defect traceable to rubbing occurs is 0°−10° C.: 0 °<θ2−θ3<10° C.

The above described structural arrangement for preventing the image defect of the first type, however, had a problem in that its employment was likely to trigger the image defect of the second type.

Next, therefore, an embodiment of the present invention, which prevents the image defect of the second type as well as the image defect of the first type, will be described. The image defect of the second type is the image defect traceable to the electrical discharge which occurs on the downstream side of the second transfer medium nipping portion N. In other words, it is the image defect which occurs as a recording paper P leaves the second transfer medium nipping portion. More specifically, if a recording paper P deviates toward the secondary transfer roller as it is moved out of the second transfer medium nipping portion, the electrical capacity between the surfaces of the recording paper and belt changes. This change triggers electrical discharge, causing the surface of the recording paper to be electrically charged. Further, the electrical capacity between the surfaces of the recording paper and secondary transfer roller 8 change as the recording paper becomes separated from the secondary transfer roller 8. This change in electrical capacity causes the potential level of the recording paper to rise, triggering electrical discharge between the surfaces of the recording paper and secondary transfer roller 8. As a result, the image defect of the second type occurs.

Thus, for the purpose of preventing this phenomenon, it is important to regulate the direction in which a recording paper is discharged from the secondary transfer medium nipping portion.

The direction in which a recording paper is discharged from the secondary transfer medium nipping portion is affected by the external diameters of the aforementioned belt backing roller 6*c* and secondary transfer roller 8. Therefore, it is important to regulate the recording paper discharging direction relative to the neutral line M shown in FIG. 3.

Figure 3:
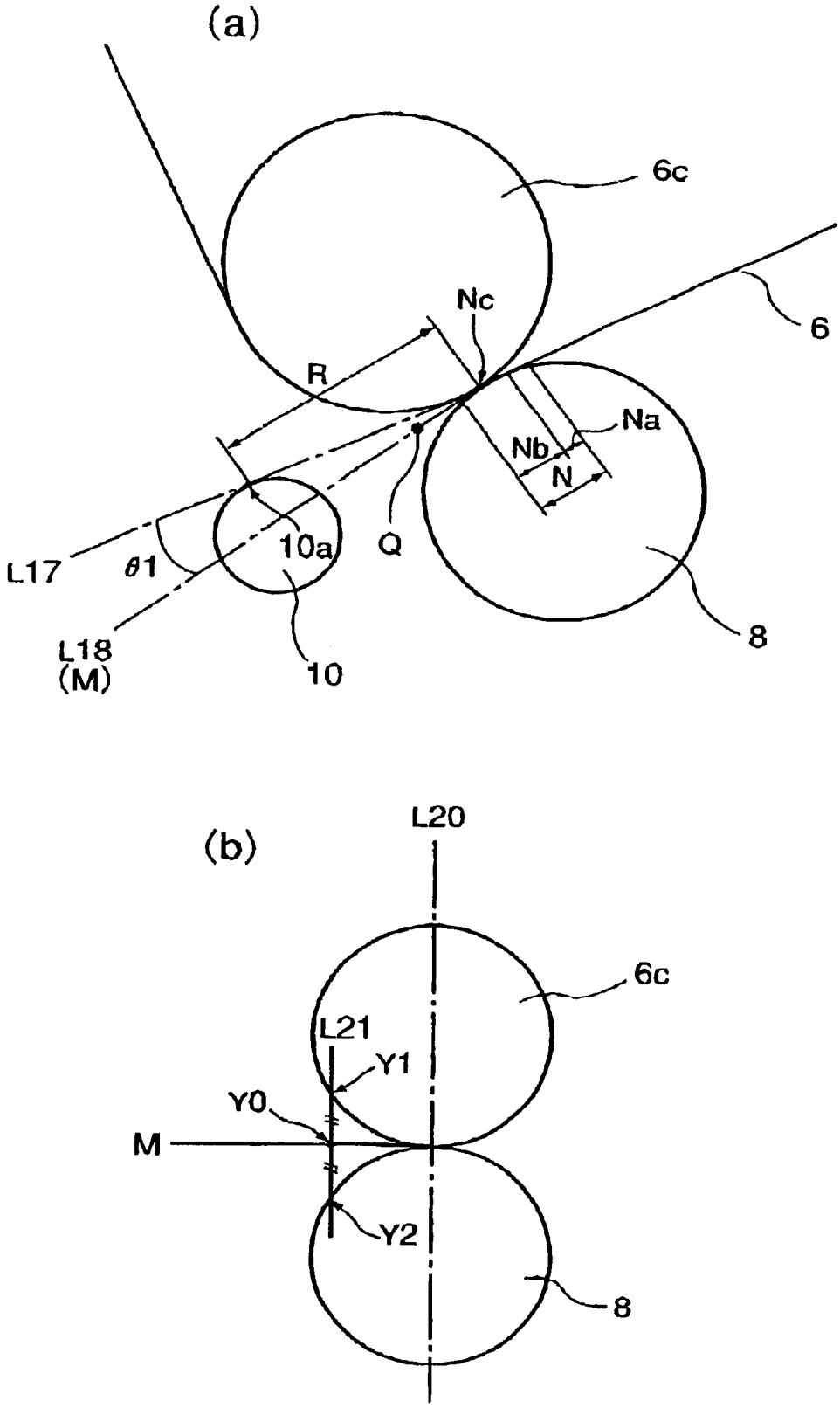
FIG. 3(*a*) is a schematic drawing for showing the position of the conveying roller on the exit side of the transfer medium nipping portion, and FIG. 3(*b*) is a schematic drawing for showing the neutral line, that is, the locus of the point equidistant from the peripheral surfaces of the secondary transfer roller and belt backing roller (opposing roller of secondary transfer roller), on the exit side of the transfer medium nipping portion.

To define the neutral line M, referring to FIG. 3(*b*), referential codes Y1 and Y2 are the points at which a given straight line L21 parallel to the straight line L20 connecting the centers of the belt backing roller 6*c* and secondary transfer roller 8 intersects with the peripheral surfaces of the belt backing roller 6*c* and secondary transfer roller 8, respectively. A referential code Y0 is the central point between the points Y1 and Y2. The neutral line M is the locus of the central point Y0, on the exit side of the secondary transfer medium nipping portion. In other words, it is the locus of the point equidistant from the peripheral surfaces of the belt backing roller 6*c* and secondary transfer roller 8 in terms of the direction (L21) parallel to the straight line connecting the centers of the belt backing roller 6*c* and secondary transfer roller 8, on the exit side of the secondary transfer medium nipping portion.

Figure 4:
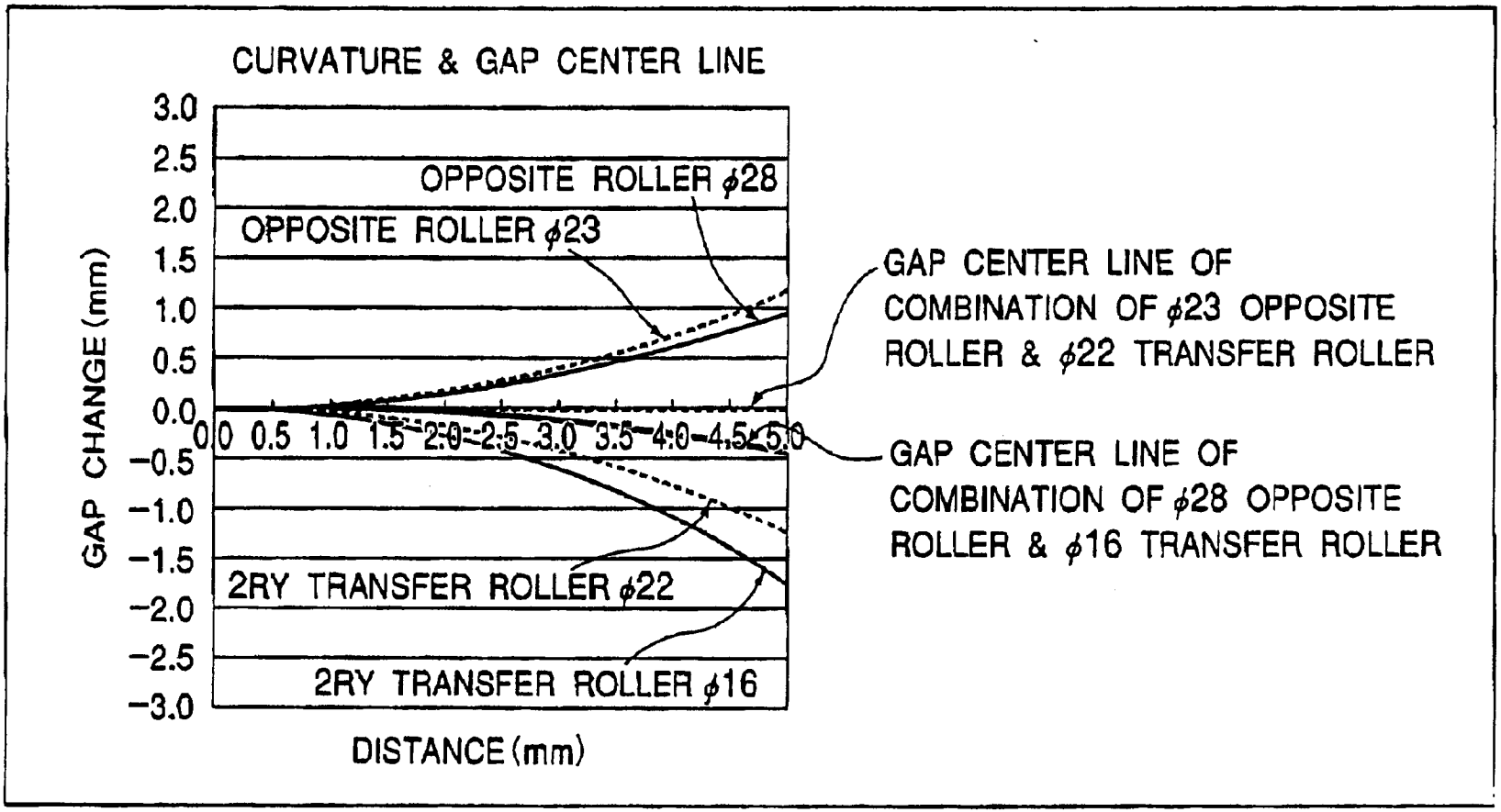
FIG. 4 is a graph showing the alteration of the neutral line caused by the changes in the external diameters of the belt backing roller and secondary transfer roller.
Figure 5:
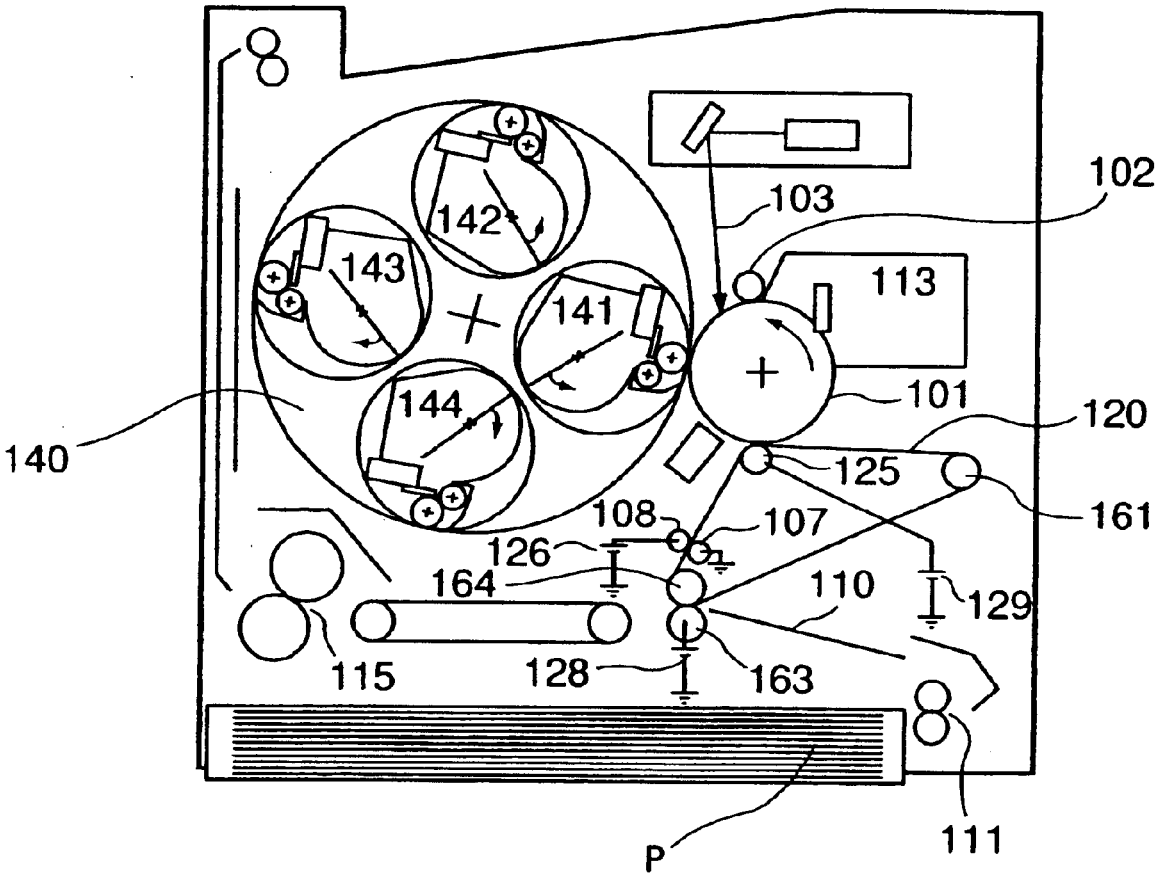
FIG. 5 Prior Art
FIG. 5 is a schematic drawing for showing the general structure of an image forming apparatus in accordance with prior arts.

The form of this neutral line is affected by the difference in external diameter between the belt backing roller 6*c* and second transfer roller 8. To further describe the neutral line M with reference to FIG. 4, the two neutral lines M in this drawing correspond to the combination of a belt backing roller 6*c* with an external diameter of 23 mm and a second transfer roller 8 with an external diameter of 22 mm, and the combination of a belt backing roller 6*c* with an external diameter of 28 mm and second transfer roller 8 with an external diameter of 16 mm. As described above, the neutral line M was defined as the locus of the point equidistant from the peripheral surfaces of the belt backing roller 6*c* and second transfer roller 8 in terms of the direction parallel to the straight line connecting the centers of the belt backing roller 6*c* and second transfer roller 8. Thus, if the belt backing roller 6*c* and second transfer roller 8 are equal in external diameter, the neutral line M becomes a straight line perpendicular to the straight line connecting the centers of the belt backing roller 6*c* and second transfer roller 8, and intersects with the straight line connecting the centers of the belt backing roller 6*c* and second transfer roller 8, at the center of the secondary transfer medium nipping portion, whereas if the belt backing roller 6*c* and second transfer roller 8 are different in external diameter, the neutral line M becomes curved as shown in FIG. 4. The neutral line M has to be concerned only in the portion of the air gap between the peripheral surfaces of the belt backing roller 6*c* and second transfer roller 8 in which it is possible for the air gap to be punctured. In this embodiment, the voltage applied to the second transfer roller is 5 kV at maximum. Thus, in consideration of the puncture of the air gap, the neutral line M has to be concerned only in the range between the downstream end of the secondary transfer medium nipping portion and the point Q approximately 3 mm from the downstream end, in terms of the direction in which a recording paper is discharged. This range can be obtained from the break down voltage of the air gap: V=612+3.2 z (Paschen's law, z: air gap; unit: μm).

The direction in which a recording paper is discharged is determined by the straight line L17 connecting the center Nc of the second transfer medium nipping portion and the recording paper supporting point on the peripheral surface of each conveying roller 10 in the conveying portion for conveying the recording paper after the separation of the recording paper from the belt backing roller 6*c* and second transfer roller 8. Therefore, the occurrence of the image defect of the second type is affected by the positional relationship between this straight line L17 and neutral line M.

Thus, the relationship between the neutral line M and each of the conveying rollers 10 will be described next. The following tables (Tables 2 and 3) shows the results of the experiments carried out to study the relationship among the neutral line M, conveying rollers 10, and image defect of the second type. The portion of the neutral line M concerning the image defect of the second type is the portion of the neutral line M between the second transfer medium nipping portion and the point Q which is approximately 3 mm from the nipping portion. Therefore, the form of the neutral line M was approximated by the straight line L18 connecting the point Q on the neutral line M and the center Nc of the second transfer medium nipping portion. As for the external diameters of the belt backing roller 6*c* and second transfer roller 8, they were 23 mm and 22 mm, respectively, in the first experiment, and 28 mm and 16 mm, respectively, in the second embodiment.

In the first and second experiments, the angle of the straight line L17 with reference to the straight line L18 is represented by θ1 (which is considered positive when straight line L17 is on the belt backing roller 6*c* side. This angle θ1 was changed from 0° to 16° by an increment of 2°. The results are shown in Tables 2 and 3.

TABLE 2

(Experiment 1)

| θ1 (deg.) | 0 | 2 | 4 | 6 | 8 | 10 | 12 | 14 | 16 |
|---|---|---|---|---|---|---|---|---|---|
| Second image defect | N | F | G | G | G | G | G | G | G |

TABLE 3

(Experiment 2)

| θ1 (deg.) | 0 | 2 | 4 | 6 | 8 | 10 | 12 | 14 | 16 |
|---|---|---|---|---|---|---|---|---|---|
| Second image defect | N | F | G | G | G | G | G | G | G |

G: No defect,
F: Slight,
N: Defective

It is evident from these results that even when the belt backing roller 6*c* and second transfer roller 8 were different in external diameter, images free of the image defect of the second type traceable to electrical discharge could be obtained as long as each conveying roller 10 was positioned so that the recording paper supporting point of the conveying roller 10 was positioned on the belt backing roller 6*c* side of the neutral line M, and so that θ1 became no less than 2°, preferably, no less than 4°.

Based on the above described points, the combination of a secondary transfer roller with an external diameter of 22 mm and a belt backing roller with an external diameter of 23 mm, and the combination of a secondary transfer roller with an external diameter of 16 mm and a belt backing roller with an external diameter of 23 mm are each mounted in the above described apparatus in a manner to satisfy the conditions: (θ2−θ3=5°; θ1=6°, and images were formed under the low temperature and low humidity environment, using the aforementioned glossy paper (Futura (brand name)). As a result, satisfactory images, that is, images free of the image defect of the first type, image defect of the second type, as well as smearing traceable to rubbing, were obtained.

As described above, according to this embodiment, the image defect of the first type and the image defect of the second type can be prevented as long as (θ2−θ3>0) is satisfied and a guiding member for controlling θ1 is provided.

Next, another embodiment of the present invention will be described. Basically, this embodiment is the same as the preceding one. Thus, only the portions in which this embodiment is different from the preceding one will be described.

The preceding embodiment described above can prevent the image defect of the second type traceable to the electrical discharge which occurs as a recording paper deviates toward the transfer roller while it is discharged from the secondary transfer medium nipping portion. Sometimes, however, image defects of a third type occur if the conveying rollers makes a recording paper deviate too much toward the belt backing rollers.

The image defect of the third type occurs for the following reason. When a recording paper is made to deviate toward the belt backing roller as it is discharged from the secondary transfer medium nipping portion, the electrical discharge between the recording paper and second transfer roller is more vigorous, giving electrical charge to the back side of the recording paper. This electrical charge on the back side of the recording paper leaks to the grounding surface of the conveying portion, causing the image defect of the third type, which has the appearance of polka dots.

This embodiment is for preventing the image defect of this third type. The results of the experiments carried out to test this embodiment of the present invention under the condition similar to the conditions under which the preceding embodiment was tested are given in Tables 4 (first experiment) and 5 (second experiment).

TABLE 4

(Experiment 1)

| θ1 (deg.) | 0 | 2 | 4 | 6 | 8 | 10 | 12 | 14 | 16 |
|---|---|---|---|---|---|---|---|---|---|
| Third image defect | G | G | G | G | G | G | G | F | N |

TABLE 5

(Experiment 2)

| θ1 (deg.) | 0 | 2 | 4 | 6 | 8 | 10 | 12 | 14 | 16 |
|---|---|---|---|---|---|---|---|---|---|
| Second image defect | G | G | G | G | G | G | G | N | N |

G: No defect,
F: Slight,
N: Defective

It is evident from the results given in Tables 4 and 5 that even when the belt backing roller and second transfer roller were different in external diameter, images free of the image defects of the third type could be obtained by positioning the belt backing roller, second transfer roller, and conveying rollers so that the position (θ1) of each conveying roller relative to the neutral line became no more than 12°.

In other words, in consideration of the image defect of the third type as well as the image defect of the second type, the preferable range of θ1 is 2°12°: 2 °<θ1<12°.

Based on the above points, the combination of a secondary transfer roller with an external diameter of 22 mm and a belt backing roller with an external diameter of 23 mm, and the combination of a secondary transfer roller with an external diameter of 16 mm and a belt backing roller with an external diameter of 23 mm were each mounted in the above described apparatus in a manner to satisfy the conditions: (θ2−θ3=5°; θ1=6°), and images were formed under the low temperature and low humidity environment, using the aforementioned glossy paper (Futura (brand name)). As a result, satisfactory images, that is, images free of the image defect of the first type, image defect of the second type, smearing traceable to rubbing, as well as the image defect of the third type, were obtained.

Next, another embodiment of the present invention will be described. In principle, this embodiment is similar to the preceding embodiments. Therefore, only the matters in which this embodiment is different from the preceding ones will be described.

In this embodiment, the belt backing roller is regulated in external diameter to improve an image forming apparatus in terms of the paper separation from the intermediary transfer belt and second transfer roller.

The external diameter of the belt backing roller 6*c* which opposes the second transfer roller 8 is determined from the standpoint of the paper separation from the intermediary transfer belt and second transfer roller and the stability in transfer performance. An intermediary transferring system employing a belt is superior in paper separation to an intermediary transfer system employing a drum or the like. However, thin paper, for example, paper with a basis weight of 60 g/m$^2$, is difficult to separate from the intermediary transfer belt 6 during the secondary transfer. This tendency is exacerbated by the high humidity, and the curling which occurs in the two-sided printing mode. From the standpoint of the paper separation performance, the external diameter of the belt backing roller 6*c* is desired to be as small as possible. However, the excessive reduction in the external diameter of the belt backing roller 6*c* makes the secondary transfer medium nipping portion unstable in position, therefore making the transfer performance unstable.

As will be inferred from the above description, the external diameter of the belt backing roller 6*c* is determined in consideration of the transfer performance in terms of image uniformity, the recording paper separation, and the like.

A roller, as the second transfer roller 8, which was 14 mm in the diameter of its metallic core, and 22 mm in external diameter, and a roller, as the belt backing roller 6*c*, which comprised a metallic core, and a 2.0 mm thick rubber layer coated on the peripheral surface of the metallic core, and which was no more than $1\times10^6$ Ω in electrical resistance and 30 degrees in hardness (JISA), were installed in the above described apparatus, and were evaluated for the recording paper separation and transfer performance.

As for the specification of the belt backing roller, five belt backing rollers, the diameters of which ranged from 16 mm to 27 mm, as shown in Table 6, and which were the same in the rubber layer thickness while being different in the metallic core diameter, were installed in the above described image forming apparatus, and images were formed using this apparatus and thin paper with a basis weight of 60 g/m$^2$, more specifically, Badger Bond (brand name) thin paper, under the environment in which temperature and humidity were 30° C. and 80% RH, respectively.

TABLE 6

| Opposite Roller Diameter | φ16 mm | φ18 mm | φ20 mm | φ25 mm | φ27 mm |
|---|---|---|---|---|---|
| Separation/ Transfer | G/F | G/G | G/G | G/G | F/G |

G: Good,
F: Slightly defective

As for the results, when the diameter of the belt backing roller was no less than 27 mm, the recording paper separation was not very good. In particular, when the recording papers curled downward while printing on the first side in the two-sided printing mode, they were likely to wrap around the intermediary transfer. When the diameter of the belt backing roller was no more than 16 mm, the secondary transfer medium nipping portion became unstable, adversely affecting the transfer performance. It is known that a recording paper separates from the intermediary transfer belt and second transfer roller due to their curvature and the resiliency of the recording paper. This is the reason why the recording paper separation was not very enough when the diameter of the belt backing roller was no less than 27 mm. Further, the reason why the smaller the diameter of the belt backing roller, the worse the transfer performance, is that the smaller the diameter of the belt backing roller, the narrower the secondary transfer medium nipping portion, and therefore, the worse the transfer performance, in particular, in terms of the secondary colors. In addition, the smaller the diameter of the belt backing roller, the more unstable the secondary transfer medium nipping portion itself, and therefore, the worse the transfer performance in terms of positional accuracy Thus, the external diameter D (mm) of the belt backing roller is desired to satisfy the following inequity: 16 mm<D<27 mm.

Based on the above points, the combination of a secondary transfer roller with an external diameter of 22 mm and a belt backing roller with an external diameter of 23 mm, and the combination of a secondary transfer roller with an external diameter of 16 mm and a belt backing roller with an external diameter of 23 mm were each mounted in the above described apparatus in a manner to satisfy the following conditions: (θ2−θ3=5°; θ1=6°), and 10,000 prints were made under the high temperature and high humidity environment, using thin paper (16 pound paper). In this printing operation, there was no paper separation problem. Further, even when the same image forming apparatus was used under the low temperature and low humidity environment, satisfactory images, that is, images free of the image defect of the first type, image defect of the second type, image defect of the third type, as well as the smearing traceable to rubbing, were obtained.

Next, another embodiment of image forming apparatus in accordance with the present invention will be described with reference to the appended drawings.

FIG. 3 is a schematic drawing for showing the relationship between the distance between the conveying rollers and secondary transfer medium nipping portion, and such an image defect of the second type that occurs across the edge portions of a recording paper in terms of the widthwise direction of the recording paper (direction perpendicular to recording paper conveyance direction). The portions of the apparatus and their positioning, which are identical to those in the preceding embodiments are given the same referential codes as those in the preceding embodiments, and their description will be not be given here.

Generally, in order to prevent the fixing device and secondary transfer medium nipping portion from pulling a recording paper, the recording paper conveyance speed of the fixing device is made approximately 1% slower than that of the secondary transferring means. Therefore, while a recording paper is in both the fixing nipping portion of the fixing device and the secondary transfer medium nipping portion of the transferring means at the same time, the portion of the recording paper between the fixing device and secondary transfer medium nipping portion slightly sags downward. Further, as a recording paper is passed through the fixing device for fixation, it is made slightly wavy. Thus, when a recording paper is passed through the fixing device for the second time in the two-side printing mode, it is slightly wavy. It became evident that this waviness and sagging of a recording paper sometimes adversely affects the performance of the conveying rollers as means for regulating the direction in which the recording paper is discharged from the secondary transfer medium nipping portion. In other words, in an image forming apparatus structured as described above, the image defect of the second type also occurs due to the apparent deviation of the recording paper toward the second transfer roller caused by the sagging of a recording paper between the secondary transfer medium nipping portion and conveying rollers, and the waviness of a recording paper caused by the fixing device, although the occurrence is rare and only across the edge portions of the recording paper. In order to counter the effects of this sagging of a recording paper, the inventors of the present invention studied the relationship between the image defect of the second type and the distance R between the recording paper supporting point 10*a* of the conveying roller and the center Nc of the secondary transfer medium nipping portion, obtaining the results shown in Table 7.

TABLE 7

| Distance R (mm) | 20 | 18 | 17 | 16 |
|---|---|---|---|---|
| Second image defect at end | F | G | G | — |

G: No defect,
F: Slightly defective

When the distance R was no less than 20 mm, the above described sagging occurred, making it more likely for the image defect of the second type to occur. Making the distance R shorter than 16 mm is difficult because of the limitations in the apparatus design. Thus, the optimum range for the distance R is 17–18 mm.

Based on the above points, the combination of a secondary transfer roller with an external diameter of 22 mm and a belt backing roller with an external diameter of 23 mm was mounted in the above described apparatus in a manner to satisfy the following requirements: R=18 (mm); $\theta 2-\theta 3=5°$; and $\theta 1=8°$, and images were formed under the low temperature and low humidity environment, using glossy paper (Futura (brand name)) with a basis weight of 32 pounds. As a result, satisfactory images, that is, images free of the rare image defect of the second type, that is, the image defect of the second type, which occurs across the edge portion of a recording paper, and is traceable to the sagging of the recording paper, were obtained.

It is needless to say that not only is the present invention effectively applicable to the transferring means structure of an in-line type color image forming apparatus employing an intermediary transfer belt, but also to that of an image forming apparatus employing a belt type photoconductive member.

While the invention has been described with reference to the structures disclosed herein, it is not confined to the details set forth, and this application is intended to cover such modifications or changes as may come within the purposes of the improvements or the scope of the following claims.

What is claimed is:

1. An image forming apparatus comprising:

an image bearing belt;

a supporting roller for supporting said image bearing belt;

a transfer roller for forming a nip with said image bearing belt, wherein an image is transferred from said image bearing belt onto a movable transfer material at said nip by applying a voltage to said transfer roller;

wherein said nip has a first nip portion where said transfer roller is contacted to said image bearing belt without being backed up by said supporting roller, and a second nip portion where said transfer roller is contacted to said image bearing belt by being backed up by said supporting roller, said first nip portion being upstream of said second nip portion with respect to a moving direction of the transfer material; and a rotatable regulating member for regulating a discharging direction of the transfer material to be discharged from said nip, wherein an angle $\theta 2$ formed between a horizontal line and a line perpendicular to a line connecting centers of said supporting roller and said transfer roller, and an angle $\theta 3$ formed between a horizontal line and a line along which said image bearing belt is stretched before said nip, satisfy:

$$0 \text{ degree} < \theta 2-\theta 3 < 10 \text{ degree}.$$

2. An apparatus according to claim 1, wherein a line connecting a center of said nip and a regulating position of said regulating member is disposed in a supporting roller side of a center line which is equidistant from said supporting roller and said transfer roller, with respect to a direction of a line connecting centers of said supporting roller and said transfer roller.

3. An apparatus according to claim 2, wherein an angle $\theta 1$ formed between the line connecting the center of said nip and the regulating position of said regulating member, and a line approximating said center line, satisfy:

$$2 \text{ degrees} < \theta 1 < 12 \text{ degree}.$$

4. An apparatus according to claim 1, wherein a distance between a center of said nip and a regulating position of said regulating member is 17–18 mm.

5. An apparatus according to claim 1, wherein said regulating member is in the form of a roller.

6. An apparatus according to claim 1, wherein said image bearing belt functions as an intermediary transfer belt.

7. An image forming apparatus comprising:

an image bearing belt;

a supporting roller for supporting said image bearing belt;

a transfer roller for forming a nip with said image bearing belt, wherein an image is transferred from said image bearing belt onto a movable transfer material at said nip by applying a voltage to said transfer roller;

wherein said nip has a first nip portion where said transfer roller is contacted to said image bearing belt without being backed up by said supporting roller, and a second nip portion where said transfer roller is contacted to said image bearing belt by being backed up by said supporting roller, said first nip portion being upstream of said second nip portion with respect to a moving direction of the transfer material; and a rotatable regulating member for regulating a discharging direction of the transfer material to be discharged from said nip, wherein a line connecting a center of said nip and a regulating position of said regulating member is disposed in a supporting roller side of a center line which is equidistant from said supporting roller and said transfer roller, with respect to a direction of a line connecting centers of said supporting roller and said transfer roller, and wherein an angle θ1 formed between the line connecting the center of said nip and the regulating position of said regulating member, and a line approximating said center line, satisfy:

$$2 \text{ degrees} < \theta 1 < 12 \text{ degrees}.$$

8. An apparatus according to claim 7, wherein an angle θ2 formed between a horizontal line and a line perpendicular to a line connecting centers of said supporting roller and said transfer roller, and an angle θ3 formed between a horizontal line and a line along which said image bearing belt is stretched before said nip, satisfy:

$$0 \text{ degree} < \theta 2 - \theta 3 < 10 \text{ degrees}.$$

9. An apparatus according to claim 7, wherein a distance between a center of said nip and a regulating position of said regulating member is 17–18 mm.

10. An apparatus according to claim 7, wherein said regulating member is in the form of a roller.

11. An apparatus according to claim 7, wherein said image bearing belt functions as an intermediary transfer belt.

* * * * *

UNITED STATES PATENT AND TRADEMARK OFFICE

CERTIFICATE OF CORRECTION

PATENT NO. : 6,834,177 B2
DATED : December 21, 2004
INVENTOR(S) : Hisahiro Saito et al.

It is certified that error appears in the above-identified patent and that said Letters Patent is hereby corrected as shown below:

Title page,
Item [56], References Cited, FOREIGN PATENT DOCUMENTS, "JP 63-301960 12/1998" should read -- JP 63-301960 12/1988 --.
Item [57], ABSTRACT ,
Line 13, "ing the" should read -- ing --.

Column 4,
Line 52, "bird s" should read -- bird's --

Column 7,
Line 37, "details." should read -- detail. --.

Column 14,
Line 36, "accuracy" should read -- accuracy. --.

Signed and Sealed this

Twenty-sixth Day of April, 2005

JON W. DUDAS
*Director of the United States Patent and Trademark Office*